US006679336B2

(12) United States Patent
Musselwhite et al.

(10) Patent No.: US 6,679,336 B2
(45) Date of Patent: Jan. 20, 2004

(54) MULTI-PURPOSE FLOAT EQUIPMENT AND METHOD

(75) Inventors: Jeffrey D. Musselwhite, Houston, TX (US); Jeffry C. Ehlinger, Houston, TX (US); Jerry P. Allamon, Montgomery, TX (US); Jack E. Miller, Houston, TX (US)

(73) Assignee: Davis-Lynch, Inc., Pearland, TX (US)

( * ) Notice: Subject to any disclaimer, the term of this patent is extended or adjusted under 35 U.S.C. 154(b) by 0 days.

(21) Appl. No.: 09/982,618

(22) Filed: Oct. 17, 2001

(65) Prior Publication Data

US 2002/0033262 A1 Mar. 21, 2002

Related U.S. Application Data

(63) Continuation-in-part of application No. 09/524,117, filed on Mar. 13, 2001, now Pat. No. 6,401,824.

(51) Int. Cl.[7] ..... E21B 34/06

(52) U.S. Cl. ..... 166/386; 166/242.8; 166/327; 166/334.4; 166/332.8

(58) Field of Search ..... 166/242.8, 386, 166/150, 152, 145, 156, 154, 194, 222, 327, 328, 334.4, 332.8, 318

(56) References Cited

U.S. PATENT DOCUMENTS

| | | | | |
|---|---|---|---|---|
| 2,735,498 A | | 2/1956 | Muse | |
| 2,751,021 A | | 6/1956 | Muse | |
| 3,032,050 A | | 5/1962 | Clark, Jr. | |
| 3,148,731 A | | 9/1964 | Holden | |
| 3,995,692 A | | 12/1976 | Seitz | |
| 4,469,174 A | | 9/1984 | Freeman | |
| 4,474,241 A | | 10/1984 | Freeman | |
| 4,585,067 A | * | 4/1986 | Blizzard et al. | 166/386 |
| 4,664,192 A | | 5/1987 | Hogarth | |
| 4,688,593 A | | 8/1987 | Pringle et al. | |
| 4,729,432 A | | 3/1988 | Helms | |
| 4,846,281 A | | 7/1989 | Clary et al. | |
| 5,332,045 A | * | 7/1994 | Ross et al. | 166/387 |
| 5,337,819 A | * | 8/1994 | Tailby | 166/222 |
| 5,474,130 A | | 12/1995 | Davis | |
| 6,244,342 B1 | | 6/2001 | Sullaway et al. | |

OTHER PUBLICATIONS

Assembly for Flapper Valve Insert for Sub–Sea Re–entry Cement Float Shoe with TV Camera for XO–07238, Baker Drawing No. 02–35733–00, Dated Jan. 23, 1976.

* cited by examiner

*Primary Examiner*—William Neuder
(74) *Attorney, Agent, or Firm*—The Matthews Firm

(57) ABSTRACT

A float shoe/collar apparatus and method for multi-purpose use in running a tubular string such as a casing string or liner into a wellbore and for optimizing cementing operations. In one presently preferred embodiment, the apparatus permits auto filling of the tubular string as the string is lowered into the wellbore. Circulation can be effected through down jets for washing the wellbore as necessary. After the tubular string is positioned, the down jets can be blocked off and up jets opened to thereby direct cement upwardly to optimize cement placement. Check valves can also be activated to prevent flow from the wellbore into the tubular string. In one embodiment, the apparatus comprises an inner member and tubular member. The inner member is movable upon release of shear pins to cause longitudinal movement relative to the outer member. The movement of the inner member may close a plurality of downward jets and may also open a plurality of upward jets, if desired. The apparatus may also be equipped with a set of check valves which can be held open on run in, and subsequently activated to thereby automatically close upon cementing to prevent "u-tubing" of fluid back into the casing. In another embodiment a float collar comprises the same valve/valves as the float shoe, without jets. This float collar may be run in conjunction with a guide shoe, with or without jets.

54 Claims, 6 Drawing Sheets

MULTI-PURPOSE FLOAT EQUIPMENT AND METHOD

RELATED APPLICATIONS

This application is a continuation-in-part of U.S. patent application Ser. No. 09/524,117, filed Mar. 13, 2001 and issued as U.S. Pat. No. 6,401,824 on Jun. 11, 2002.

FIELD OF INVENTION

This invention relates generally to apparatus and methods for use in well completions and, more particularly, is operable for multiple purposes during the insertion and cementing of tubular strings such as casing and liners in the well bore.

BRIEF DESCRIPTION OF THE PRIOR ART

For instance, in vertical or horizontal boreholes, or sections of a well having vertical and horizontal boreholes, one or more casing strings may be lowered into the hole and anchored therein by pumping a column of cement into the annulus between the casing string and the wall of the borehole. When lowering casing/liner into the wellbore, it has become conventional practice to fill the casing/liner string with drilling fluid. However due to the volume displaced by the tubular string, surge pressure is created during the process of lowering the casing into the fluid filled wellbore. The surge pressure may damage the formation as fluid is highly compressed and forced into the formation. The surge pressure may be especially great when running close tolerance casings or liners. While devices have been used to permit fluid flow into the casing as it is lowered to thereby reduce surge pressure, problems may still occur due to limited internal casing diameters that restrict the volume of fluid flow and/or restrictions in the casing internal diameter due, for instance, to the internal diameter of float valves in the float equipment. Moreover, cuttings from the well bore may collect and bridge, for instance adjacent restrictions in the casing string, to create additional problems. Moreover, damage may occur to internal elements such as hydraulically activated liner hanger equipment, float valves, sealing elements such as seats for the float valves, or other elements, due to the abrasive fluids or cuttings from the wellbore that flow into the casing string.

When the casing string has been placed at the desired depth and is being held at the surface or placed on a hanger from a previously set casing string of larger diameter, a wiper plug may be launched into the casing/liner string. Cement may be pumped into the string above the wiper plug (called a bottom plug). The bottom plug forms a barrier that separates the cement above the bottom plug from the mud which may be below the bottom plug. Pumps at the surface are used to pump the mud, and then the cement out of the lower end of the string and/or past a float shoe, or float collar, or well tool having a back pressure valve, at its lower end and into the casing/well bore annulus. It should be mentioned that if the back pressure valve or float shoe is located at the bottom end of the casing string, the device is sometimes referred to as a float shoe. If this device is used interiorly to the length of a full casing string, the device is sometimes referred to as a float collar. Thus, one nomenclature difference in these types of devices depends on whether the device is threaded to the casing on one end (shoe), or on both ends (collar). As used herein, float equipment refers to equipment typically positioned near or adjacent the bottom of the tubular string such as casing or liner which contains valves that may be used to control back pressure that might permit cement to flow back into the casing/liner after cementing.

When the wiper plug lands on the float shoe/collar, increased pumping pressure may be used to burst or rupture a frangible diaphragm across the interior of the wiper plug to permit the cement which was above the wiper plug to be pumped into the annulus. The back pressure valve in the float shoe/collar prevents the cement positioned in the annulus from simply re-entering the casing into any cement ports below the valve after pumping stops. After the desired amount of cement has been pumped into the annulus and has been allowed to set a drilling tool may be lowered into the casing string and used to drill out the plug (or plugs) and the float shoe/collar containing the back pressure valve. This opens the lower end of the casing string, if desired, for further drilling.

Some float shoes have fluid jets, or directed openings, facing downwardly for assisting lowering of casing into place by providing downwardly directed mud jets during the casing run in to assist circulating out or washing rock cuttings present in the uncased section of borehole that might prevent the casing being lowered. The downwardly facing jets assist in moving any remaining rock cuttings in the well bore to be circulated out of the well via the annulus between the casing and borehole wall during the run in operation. Some such tools used as float shoes have had upwardly facing fluid ports or jets to assist in the distribution of cement into the borehole/casing annulus once the tool is in place. Although either of the jets are useful, float shoes having both types of fluid ports or jets are less effective because the operation of one naturally interferes with the operation of the other. Thus, it has been desirable to have one type of ports or the other but not both.

In one type of float shoe, one or more back pressure valves (or one way valves) may be positioned in place by cementing the valves into a short piece of pipe threaded to the end (when used as a shoe) or to a section between casing lengths (when used as a collar) of the casing string. These check valves prevent the re-entry of cement or mud interiorly to the casing during the run in and cementing operation.

Thus, downwardly facing ports or jets have been found useful during casing run in whereas upwardly facing jets promote the equal circumferential distribution of cement when cementing takes place. The upwardly facing jets create turbulence in the casing/borehole annulus and this tends to promote desired circumferential distribution of cement about the annulus. However, the use of both downwardly and upwardly facing jets dilutes the function of each type of jet.

The inventors have conceived that it would be desirable to optimize both the run in and the cementing operation with a float shoe or float collar that has jets directed downwardly during the run in, but then has jets directed in an upward direction during the cementing operation. If this optimization were accomplished, as discussed subsequently herein, the run in and cementing operations would be safer, more reliable, more economical, faster, and more efficient. Moreover, it would be desirable to somehow limit damage to internal components such as float valves and seating elements that may be damaged by flow of abrasive fluids that contain cuttings. Those skilled in the art will appreciate the present invention which provides solutions to the problems discussed hereinbefore.

SUMMARY OF THE INVENTION

Thus, the apparatus of the present invention may comprise a float shoe or float collar that incorporates a check valve, or a plurality of such valves, which can allow the casing to fill up from the bottom with well fluid (auto fill) during run in. Below the valve, or valves, may be a center outlet hole as well as both upwardly and downwardly facing jets. In one embodiment, a tube inside the float shoe holds the flapper or check valve(s) open to allow fluid into the casing or to permit circulation. This same tube also covers and closes a set of upwardly facing jets during run in. The downwardly facing jets are open to aid in washing the borehole wall during the casing run in or float in. Once the casing string has reached the desired depth, a drop member such as an obscuration ball may be pumped down the casing. The ball seats in the float shoe or float collar tube. With an increase in pumping pressure from the surface, the seated ball then causes the float shoe or float collar tube to move downwardly inside the tool. The downward movement allows the check valve(s) or flappers to swing closed, thus activating the check valve(s). When the tube shifts downwardly it closes and shuts off the downwardly facing jets and exposes, or opens, the upwardly facing jets to assist in cement distribution, during the cementing operation, to all sides of the casing.

The well completion equipment may further comprise one or more valve seats positioned between the outer tubular member and the inner tubular member. In one embodiment of the invention, the inner tubular member is moveable with respect to the outer tubular member from a first position to a second position for uncovering the valves and the valve seats. The outer tubular member may define one or more passageways which are blocked by the inner tubular member in the first position. The one or more passageways may be opened to permit fluid flow from within the tubular string to outside of the tubular string when the inner tubular member is moved from the first position to a second position.

The well completion float equipment may further comprise a seat secured to the inner tubular member for receiving a drop member. In one embodiment, the valves may comprise a plurality of flapper valves. The one or more valves may be held in an open position when the inner tubular member is in the first position.

The present invention may comprise an outer tubular member forming a portion of the tubular string and having at least one first opening therein and at least one second opening therein. The at least one first opening and the at least one second opening may provide a passageway between the inside and the outside of the tubular string. A moveable member may be provided which is moveable from a first position to a second position such that the moveable member blocks the at least one first opening in the first position. The moveable member may block the at least one second opening in the second position.

The well completion float equipment may further comprise one or more valve seats which may be insulated from fluid flow in the first position and may be selectively engageable with fluid flow in the second position.

In another embodiment, the well completion float equipment may also comprise a drop member mounted adjacent to the moveable member. The drop member may be operable in response to fluid pressure for engaging the moveable member.

The invention may also comprise a method for completing a well with float equipment and may be operable for use in lowering a tubular string into a wellbore. The method may comprise steps such as, for instance, covering one or more valves such that the valves are held in an open position and insulated from fluid flow through the tubular string, and selectively uncovering the valves for controlling back pressure in the tubular string.

The step of selectively uncovering may further comprise dropping a member into the tubular string. Other steps of the method may include selectively closing one or more passageways between the inside of the tubular string and the outside of the tubular string.

In one embodiment, the method may comprise steps such as blocking one or more up jets while running the tubular string into the wellbore, and selectively unblocking the one or more up jets to pump fluid in an upwardly direction with respect to the tubular string through the one or more up jets. The method may further comprise selectively blocking one or more down jets and/or selectively exposing one or more check valves to fluid pressure. The method may also comprise selectively blocking a passageway through a bottom end of the float equipment.

Thus, the apparatus of the present invention may comprise a float shoe or float collar that incorporates a check valve, or a plurality of such valves, which can allow the casing to fill up from the bottom with well fluid (auto fill) during run in. Below the valve, or valves, may be a center outlet hole as well as both upwardly and downwardly facing jets. In one embodiment, a tube inside the float shoe holds the flapper or check valve(s) open to allow fluid into the casing or to permit circulation. This same tube also covers and closes a set of upwardly facing jets during run in. The downwardly facing jets are open to aid in washing the borehole wall during the casing run in or float in. Once the casing string has reached the desired depth, a drop member such as an obscuration ball may be pumped down the casing. The ball seats in the float shoe tube. With an increase in pumping pressure from the surface, the seated ball then causes the float shoe tube to move downwardly inside the tool. The downward movement allows the check valve(s) or flappers to swing closed, thus activating the check valve(s). When the tube shifts downwardly it closes and shuts off the downwardly facing jets and exposes, or opens, the upwardly facing jets to assist in cement distribution, during the cementing operation, to all sides of the casing.

In another embodiment, a multi-purpose method is provided for completing a well having a tubular string therein. The method comprises steps such as providing a receptacle within the tubular string for receiving a drop member, providing a breakable member for the receptacle such that the breakable member breaks at a selected first pressure, and providing pressure responsive equipment in the tubular string at a well depth above the receptacle. The pressure responsive equipment could be any hydraulically operated equipment such as, for instance, hydraulically operated liner hanging equipment. The pressure operated equipment is operable at a second pressure whereby the first pressure is greater than the second pressure.

Other steps may include releasing the drop member so that it can seal the receptacle. Steps may then include pumping into the tubular string to produce a second pressure in the tubular string so as to thereby operate the pressure responsive equipment in the well, and then subsequent to operating the pressure responsive equipment, pumping into the tubular string to produce the first pressure for breaking the breakable member.

Moreover, the method may include utilizing pressure applied to the drop member to uncover one or more valves for controlling fluid flow through the tubular string, and/or utilizing pressure applied to the drop member to block off fluid flow from one or more down jets, and/or utilizing pressure applied to the drop member to open one or more up jets to thereby provide fluid flow through the up jets.

Other steps may include pumping fluid through said receptacle for circulating fluid within said well prior to releasing the drop member. For instance, this may include pumping fluid through down jets prior to releasing the drop member.

The invention may be best understood by reference to the detailed description thereof which follows and by reference to the appended drawings. The drawings are intended to be illustrative of the preferred embodiment of the invention but are not intended to be limitative of the invention as the invention may admit to several embodiments.

DETAILED DESCRIPTION OF A PREFERRED EMBODIMENT

Figure 1:
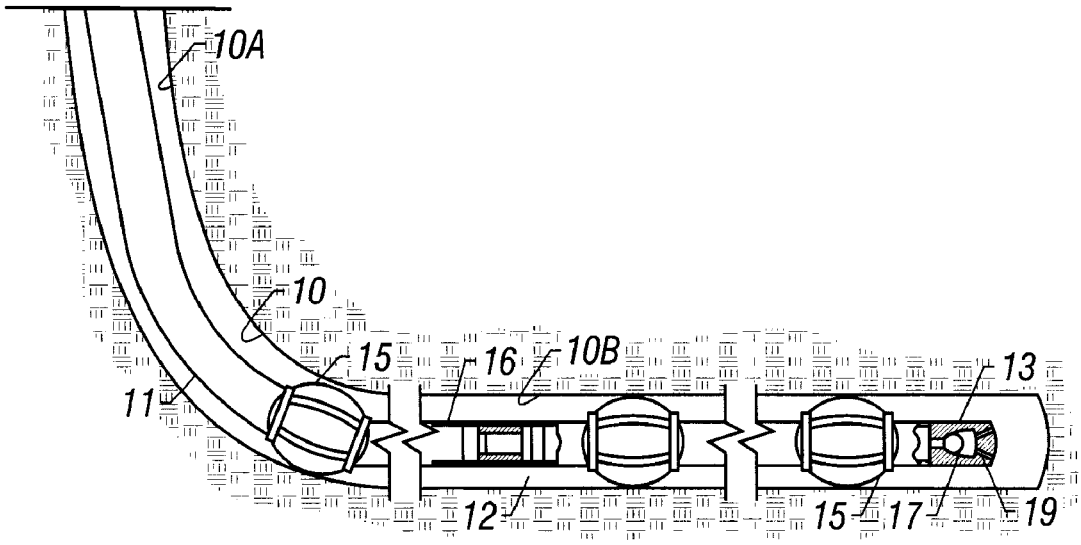
FIG. 1 is a schematic representation of a downhole casing/liner string in which the present invention may be used.

Referring now to the drawings and, more specifically to FIG. 1, there is disclosed casing string 11 within borehole 10 in accord with the present invention. The drilled borehole or wellbore 10 may be substantially vertical and/or have horizontal components. For instance, wellbore 10 may have relatively vertical sections such as section 10A and/or may have relatively horizontal sections such as section 10B. As the tubular string, such as a casing/liner string 11, is lowered into wellbore 10, it may be desirable to centralize tubular string 11 within borehole 10 by use of centralizers such as centralizers 15. Annulus 12 is defined between tubular string 11 and borehole 10. The present invention may be used with tubular strings including either casing strings or liners.

The present invention provides the ability for casing/liner 11 to self-fill as it is being run into wellbore 10. This self-filling action can significantly reduce surge pressure on the formation, and also reduce running time for the casing/liner. The use of the present invention can therefore result in substantial savings in rig time and a reduction in the amount of expensive drilling fluid that may be lost during the casing/liner run. The present invention provides many advantageous features, discussed in more detail hereinafter, such as the ability to circulate through down jets and/or the center of the shoe while running the tubular string into the hole. The present invention provides a means of washing the wellbore as required to facilitate lowering of the casing/liner. The present invention may be converted from an auto fill mode of operation to a back pressure mode of operation as explained subsequently. Once converted from the auto fill mode to the back pressure mode, the present invention provides the ability for cement to be pumped through up jets for optimum cement placement. In one presently preferred embodiment, a double valve assembly prevents cement u-tube effects after completion of the cementing operation. The use of a double valve assembly rather than a single valve assembly provides redundancy that improves reliability. In one preferred embodiment, a ball seat for conversion of the float shoe/collar serves a multi-purpose function. Conversion pressure can be adjusted to allow for setting hydraulic type liner hangers, prior to converting the shoe/collar at higher pressures. This feature allows for a single ball to be utilized rather than multiple balls. Single ball conversion on liner applications also allows for greater flow for self-filling of the casing/liner. This feature thus permits maximum surge reduction and minimizes the problems such as bridging caused by solids or cuttings from the wellbore. In some cases, there may be restrictions of various types in casing/liner string 11 such, for example only, the restriction created by tool 16. Such restrictions may prevent larger diameter drop balls from being used in the prior art. However, in accord with one embodiment of the present invention a drop ball having a diameter greater than the restriction may be used to operate the float equipment. The present invention can be used either as a float shoe or as a float collar in conjunction with a guide shoe, as discussed subsequently.

In accord with the present invention as discussed hereinafter, selectively operable upwardly directed jets may be provided for use with casing string 11. Moreover, additional downwardly directed jets may be provided for use with casing string 11 in accord with the present invention. While guide shoe 13 is shown mainly for explanatory purposes and may preferably be configured as discussed subsequently, guide shoe 13 may, if desired, include a valve such as ball valve 17 that may be used with downwardly directed jets 19. Furthermore, the present invention teaches means for protecting components, such as seal areas, from damage caused by the flow of cuttings or abrasive fluids therethrough without impeding operation of those components when operation may be selectively initiated.

Figure 2:
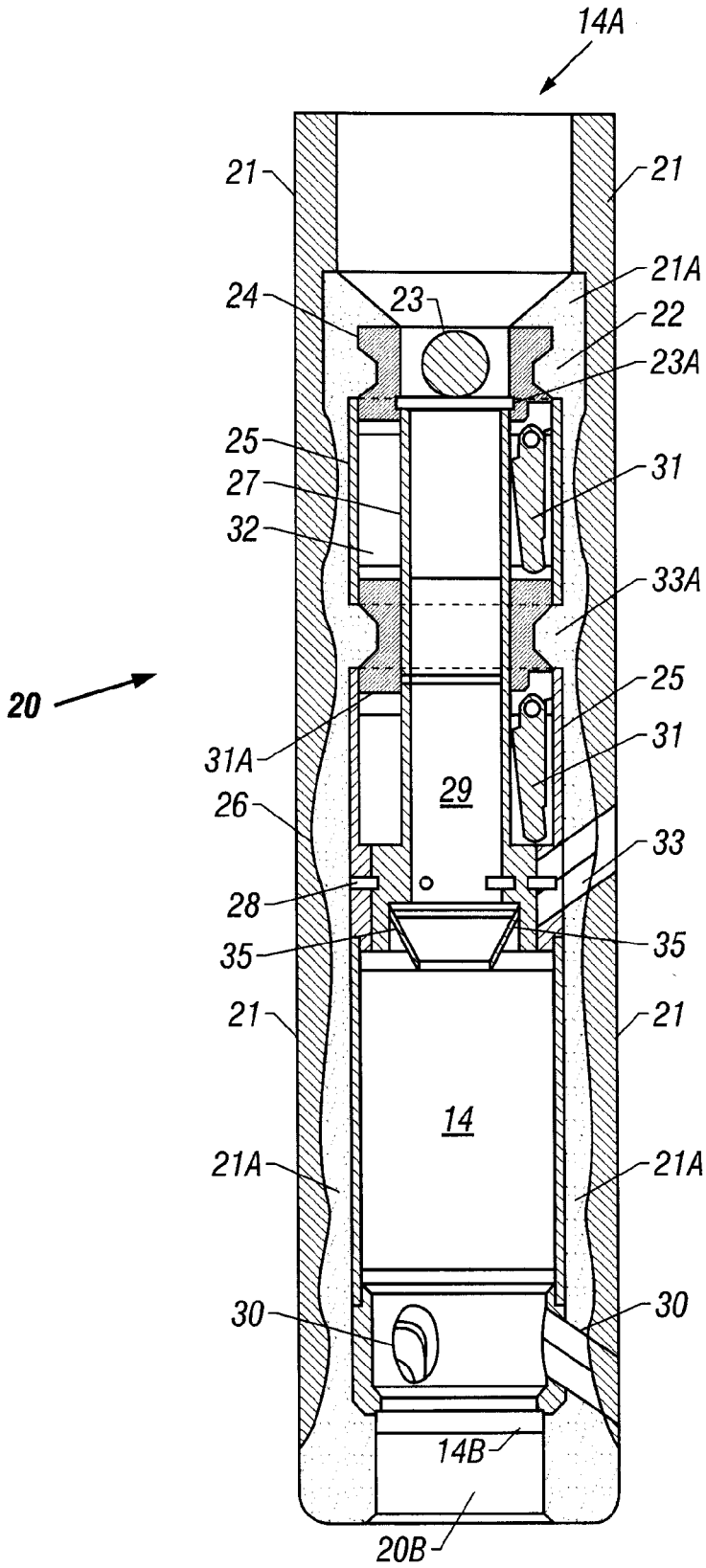
FIG. 2 is an elevational view, in section, of one embodiment of the invention (shoe form) positioned in a short section of pipe threaded on its upper end to fit the casing/liner string.

Referring now to FIG. 2, there is shown float shoe 20 in accord with one embodiment of the present invention. In accord with the present invention, float shoe 20 may include conversion tool 14 which is mounted, fastened, or affixed within pipe 21 by some means, as desired. Pipe 21 may be threaded at upper end 14A to thereby threadably attach to the threads of casing/liner string 11 adjacent the bottom of the casing/liner string.

At some time during the well completion operation, it may be desirable to drill out tool 14. Therefore, conversion tool 14 should preferably be comprised of drillable materials. As well, the mounting of conversion tool 14 within pipe 21, which may effected in different ways, should preferably be drillable such as with a drill bit that may also be used for continuing to drill into the well bore formation. Generally, the drill bit will be as large as practical to fit through casing 21 and may have an outer diameter within one-quarter inch of the inner diameter of casing 21. In this example, tool 14 may be cemented, molded, or otherwise mounted within a short piece of pipe 21. Materials such as cement, concrete, plastics, aluminum, and the like which are easily drillable maybe utilized for mounting tool 14 within pipe 21. In FIG. 2, details of one possible installation of tool 14 within short pipe section 21 are shown. Short pipe section 21 may be provided with interior teeth, grips, ridges, threads, roughed region, or grooves 26 to enhance attachment of material 21A to pipe 21. Material 21A may include any material useful in providing a sturdy but drillable attachment between tool 14 and pipe 21 such as but not limited to cement, plastics, glues, composite materials, elastomerics, fibers, or combinations of the above, or other suitable materials Thus, cylindrical body member 25 of tool 14 is held in place by material 21A and/or other attachment means such as braces, grips, latches, grooves, insets, threads, or the like, which are designed to permit optimum drilling through pipe 21 by a suitably sized drill bit. Thus, pipe 21, with tool 14 mounted therein, may be attached to the casing/liner string, run into the wellbore, and the entire tubular string cemented in place.

In one presently preferred embodiment, movable inner tubular member 27 is positioned within body member 25. Body member 25 may preferably be substantially tubular and may be cylindrical or at least partially cylindrical. Piston or inner tubular member 27 may be affixed in place by suitable means until movement of tubular member 27 so as to convert operation of conversion tool is desired as explained hereinafter. For instance, tubular member 27 may be held in place or mounted with respect to outer member 25 by one or more shear pins 28, or by other means such as shear bolts, studs, or other breakable members. The breakable members, such as shear pins 28, may be designed to shear or break when a desired lateral force is applied to them (as will be described). Once the breakable members are sheared, then inner tubular member 27 may move or slide with downward longitudinal movement with respect to cylindrical body member 25. Thus, inner tubular member 27 is selectively moveable with respect to outer member 25. The entire float shoe assembly 14, except for member 21, is constructed of frangible material so as to make it drillable after the cementing job is complete.

Figure 3:
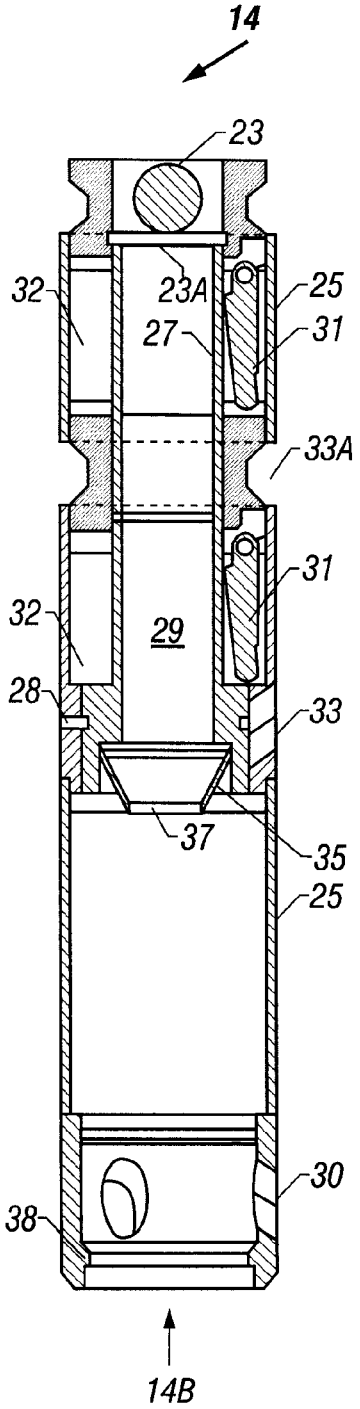
FIG. 3 is an elevational view, in section, of an embodiment of the present invention with an internal tube in its upward position.

In FIG. 2 and FIG. 3, an activation ball 23 is shown seated on catcher/seat 23A. However, ball 23 could also be kept on the surface until it is desired to activate the apparatus of FIG. 2 for conversion of tool 14 as discussed subsequently. In one aspect of the invention, if activation ball 23 is mounted adjacent tool 14 such as on seat 23A, then activation ball 23 may have a larger diameter than restriction 16 or any other restrictions which may be positioned in casing/liner string 11, as desired. A larger ball diameter may be advantageous for reasons related to enlarged flow paths and valves as discussed below. Therefore, the present invention provides the option of placing the ball downhole, if desired. It will be understood that instead of an activation ball, any activation member may be used such as plugs, darts, rods, shafts, or any other design for using fluid pressure. Catcher/seat 23A, if used, may be designed as a cage to contain operation ball 23 in this general position until sufficient fluid pressure is applied to seat 23A to break the seat and permit ball 23 to drop for conversion purposes. Catcher/seat 23A, if used, is also drillable material, as is tool 14, and may be constructed of aluminum or other suitable materials. Operation ball 23 or other drop members are also drillable.

Bore 29 of inner member 27 may be fully open during the run in for auto fill, i.e., to permit fluid to fill casing/liner 11 as the casing/liner is run into wellbore 10 to thereby reduce surge pressure and also to reduce running time for the casing/liner 11. The outer member 25 may be provided with a plurality of downwardly facing jet openings 30 at its lower end which are open during the run in operation. While openings 30 are preferably down jets that direct at fluid at least partially downwardly, openings 30 could also be directed upwardly, laterally, tangentially, or in any other desired direction. Openings 30 could direct fluid outwardly and downwardly. The bottom opening 14B of tool 14 may or may not also be open during run in to allow fluid entry/exit therethrough. Thus, fluid entry/exit may be provided, if desired, through both down jets 30 and bottom opening 14B. Fluid pumped under pressure from the surface exits all the desired openings. If necessary, circulation may be maintained to "wash" or circulate rock cuttings left in the hole upwardly through annulus 12 while running the casing/liner into wellbore 10, assisted by the operation of downwardly facing fluid jets 30.

Conversion tool 14 may preferably, but not necessarily, be provided with at least one check valve 31, and in the embodiment shown, conversion tool 14 includes a plurality of check valves 31. In one preferred embodiment, additional check valves provide redundancy and thereby increase reliability of operation. In this example, check valves 31 are flapper valves, which are held in their open or inactivated position in interior annulus 32 between inner member 27 and outer member 25 while tool 14 is in the run position. Since check valves 31 are completely covered by inner member 27, check valves 31 are completely protected from damage due to abrasive materials or cuttings that may flow through passageway 29. Not only are check valves 31 protected, but also seats 31A are also protected from abrasive materials or cuttings. Thus, when this embodiment of the present invention is converted to back pressure mode whereby check valves 31 are activated, then the flapper valves and their respective seats are completely free from any wear or contamination that might be caused by auto fill. This feature provides additional reliability of operation.

Outer member 25 and pipe section 21 may also be provided with upwardly facing jet openings 33. In one embodiment, up jets 33 are initially blocked to prevent fluid flow therethrough in the run in position as shown in FIG. 2 and FIG. 3. Thus, in the run in position, or auto fill position, fluid flow is prevented through openings 33. Moreover, while openings 33 could be formed to direct fluid laterally, downwardly, tangentially, circumferentially, or other any direction, openings 33 are preferably up jets that direct fluid at least partially upwardly. Openings 33 may direct fluid upwardly and outwardly having a vertical and lateral component.

Figure 4:
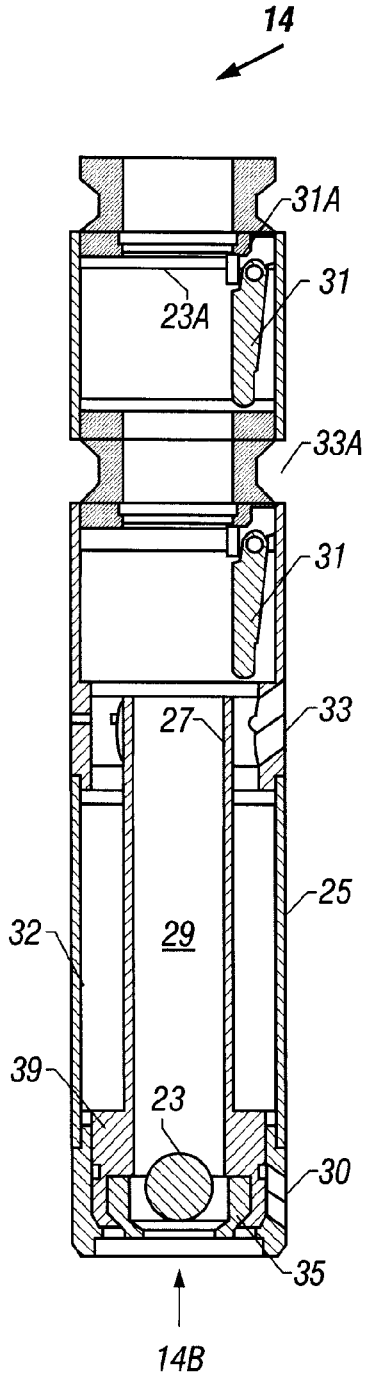
FIG. 4 is an elevational view, in section, of the apparatus of FIG. 3 with the internal tube in its downward position and with the check valves activated.
Figure 5:
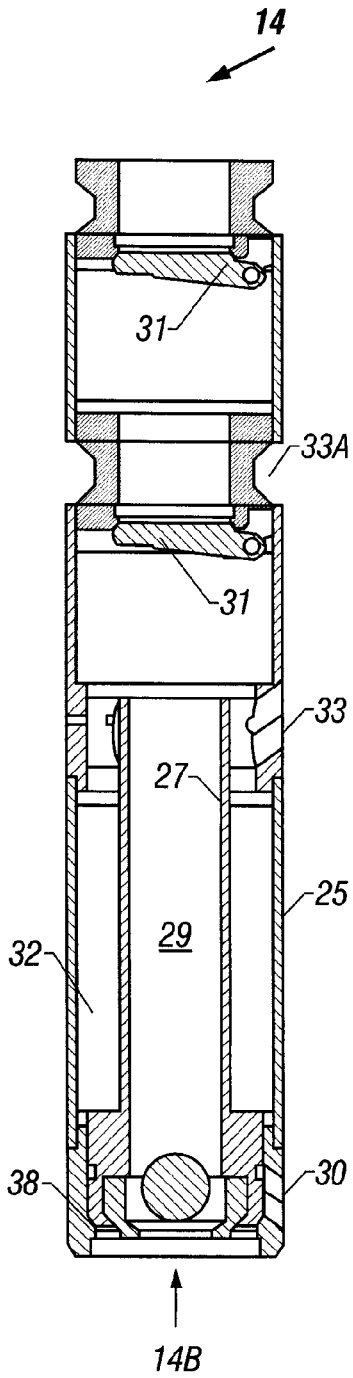
FIG. 5 is an elevational view, in section, of the apparatus of FIGS. 3 and 4 with the check valves closed.

Referring now to FIGS. 3, 4, and 5, conversion tool 14, which may be mounted within tubular 21 by cement sheath 21A as discussed above, is shown with components thereof in three different operating positions. FIG. 3 shows the apparatus in the auto fill up mode (or run in mode) with bore 29 fully open to fluid flow and fluid jets 30 and bottom opening 14B also fully open. FIG. 4 and FIG. 5 show conversion tool 14 in the converted position. In FIG. 4 and FIG. 5, activation ball 23 has been caught on a catcher portion 35 of inner member 27 at its lower end. Pressure build up occurs since ball 23 seals hole 37 to thereby apply shearing force to shear pins 28. Once shear pins 28 are broken, then member 27 is released to move. Member 27 with ball 23 mounted on catcher 35 effectively forms a movable integral piston which moves downwardly until caught on a shoulder 38 of outer member 25 at its lower end. The plug end 39 formed by movable inner member 27 blocks off downwardly facing jets 30 and the lower opening 14B of the conversion tool 14 thereby preventing fluid flow through down jets 30 and out the bottom of float shoe 20.

In FIG. 4 the valves 31 are still open. Valves 31 may be held open after passage of piston assembly member 27 by fluid flow due to pump pressure from above. Moreover, valves 31 can be opened anytime by pumping fluid downwardly therethrough such as during cementing operations. However, valves 31 seal if fluid attempts to flow the opposite direction to thereby prevent cement u-tube effects. Thus, the pumped cement remains positioned around casing 11. Preferably, valves 31 are biased to the closing position with biasing elements such as with springs, elastomerics, and the like.

The conversion motion of member 27 discussed above may also be used to uncover the upwardly facing jets 33. Therefore, conversion tool 14 may also permit cement to be directed in a desirable manner so as to be better distributed within the annulus between the casing and borehole wall, such as a distribution equally about all exterior sides of casing string 11 in accord with the present invention. Once pumping stops, then check valves 31 may close automatically. Preferably check valves 31 are spring loaded or biased to the closed position. Thus, a brief release of the pumping pressure from the surface allows valves 31 to close and seat, thus preventing the cement from "u tubing" or "flowing" back into the casing between pump strokes. Valves 31, when activated, thus act as check valves for this purpose.

Figure 6:
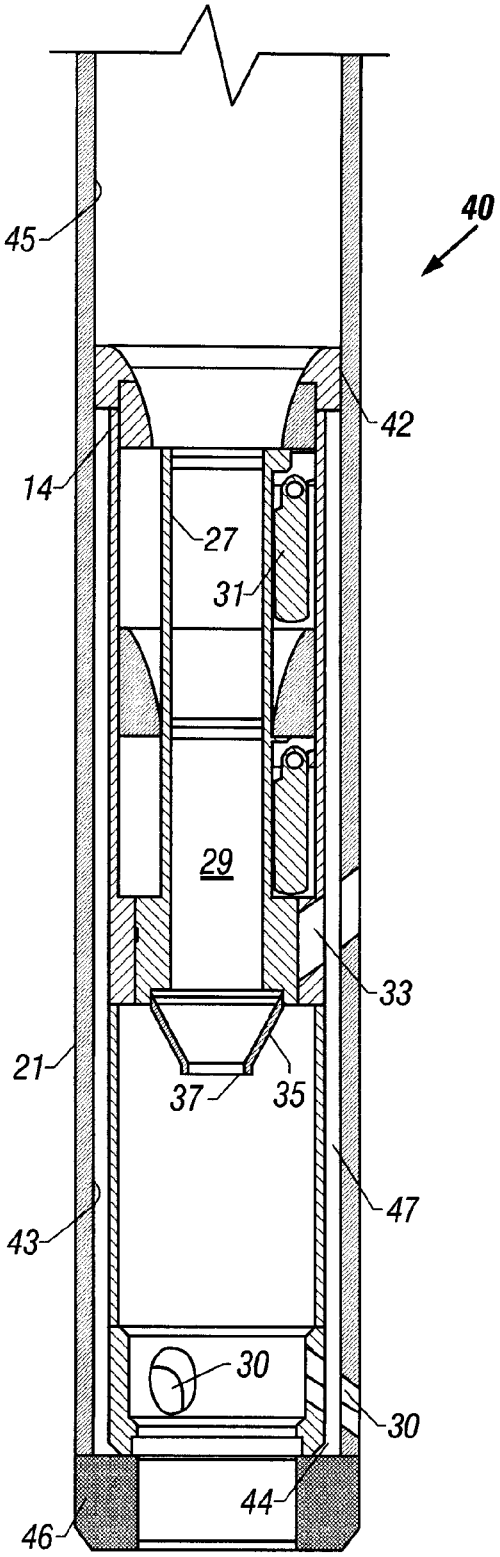
FIG. 6 is an elevational view, in section, of yet another embodiment of the present invention in the run-in position.
Figure 7:
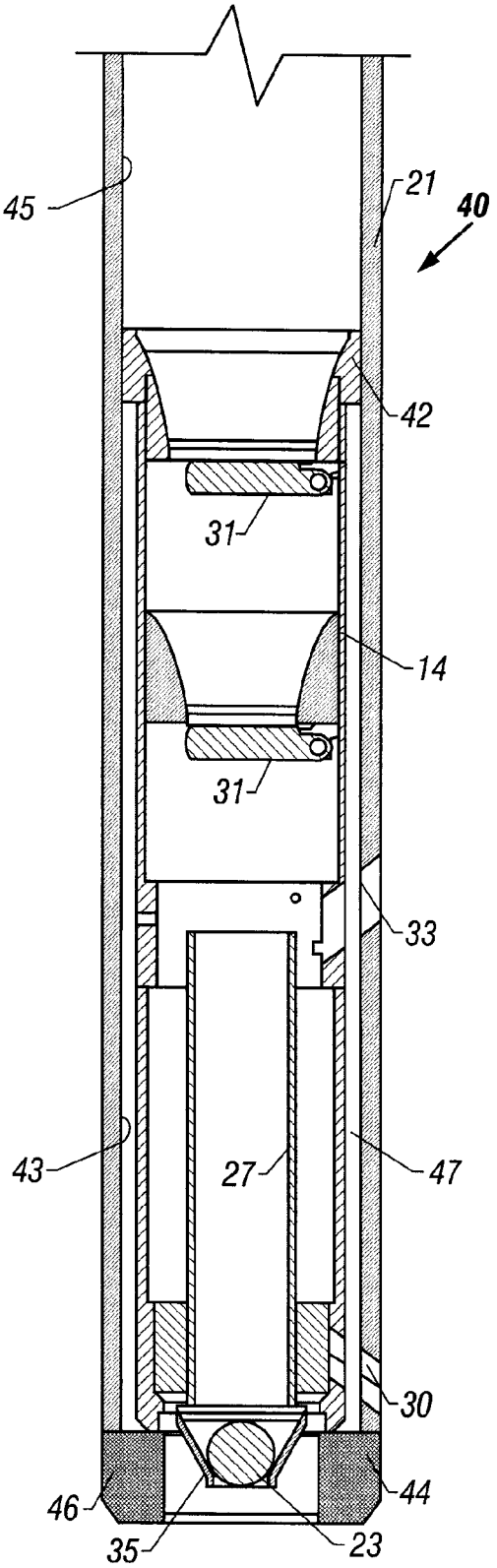
FIG. 7 is an elevational view, in section, of the embodiment of FIG. 6 in the converted position.
Figure 8:
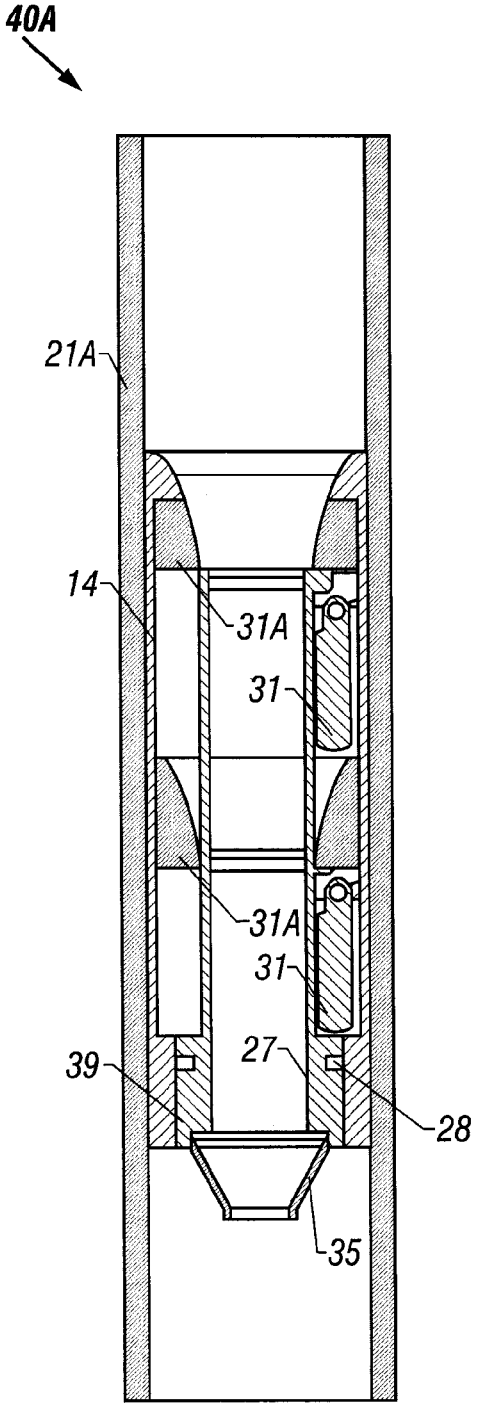
FIG. 8 is an elevational view, in section, of yet another embodiment of the present invention (collar form) which discloses a double-valve float collar in the run-in position in accord with the present invention.

FIG. 6 and FIG. 7 show another embodiment of the multi-purpose auto fill float shoe 40 of the present invention. Float shoe 40 was designed to maximize reduction of surge pressure when running close-tolerance casing or liners. In this embodiment, a large inside diameter relative to the casing diameter, is provided through passageway 29 along with large diameter valves, and maximum diameter ball sizes. Ball 23 as used in this specification may refer to any drop element such as darts, plugs, rods, and the like. The larger relative internal diameter allows for longer circulation with harsher fluids at greater pump rates. Moreover, the larger internal diameters are less likely to bridge off due to cuttings accumulation. As well, the larger diameter permits more precise conversion pressures across the shear mechanism 28 (FIG. 8). Thus, the present invention may permit setting hydraulically activated liner hanger equipment without the need for additional landing collars or setting balls. Once ball 23 is dropped, then the hydraulically activated liner equipment can be operated at a pressure lower than the conversion pressure. After the liner equipment is operated, then conversion of conversion tool 14 can be effected and only one drop ball is used thereby providing more fluid flow during run in due to few restrictions. In fact, this process could be used to operate any other hydraulic equipment in tubular string 11 and multiple sets of hydraulic equipment, which may or may not operate at different pressures, if desired.

In this embodiment, conversion tool 14 is mounted within pipe 21 of float shoe 40 between upper shoulder 42 and lower shoulder 44. If desired, internal diameter 43 may be somewhat enlarged as compared to internal diameter 45 to thereby provide a ledge or grip to support shoulder 42. As well, annular region 47 may be filled in with cement or other material if necessary as discussed above for supporting conversion tool 14 and/or providing a seal between ports 33 and 30 so that the ports may be separately operated as discussed hereinbefore. If no fill material is used within region 47, then an appropriate seal, which may be an O-ring seal or any other type of suitable seal may be used for sealing between ports 33 and 30. Moreover, the outer diameter of conversion tool 14 may be enlarged to fill in region 47 if desired. Lower shoulder 44 is formed on nose element 46 which may be comprised of drillable material such as aluminum. Conversion tool may be inserted into tubular 21 and nose element then attached thereto. Since conversion tool 14 is securely supported by upper shoulder 42 and lower shoulder 44, then little or no cement/glue or other materials are required to secure conversion tool 14 with respect to pipe 21 thereby permitting for a larger useable internal diameters. This embodiment also provides up jets 33 and down jets 30, as discussed hereinbefore. In FIG. 6, sleeve 27 is in the run in position for auto fill. In FIG. 7, drop ball 23, which may for instance be a two inch diameter drop ball or whatever a sufficient size to enable running some such, has engaged and sealed seat 35 so that sleeve 27 is forced to the converted position as discussed hereinbefore. This embodiment also provides for a double-valved float shoe with two large diameter valves 31.

Figure 9:
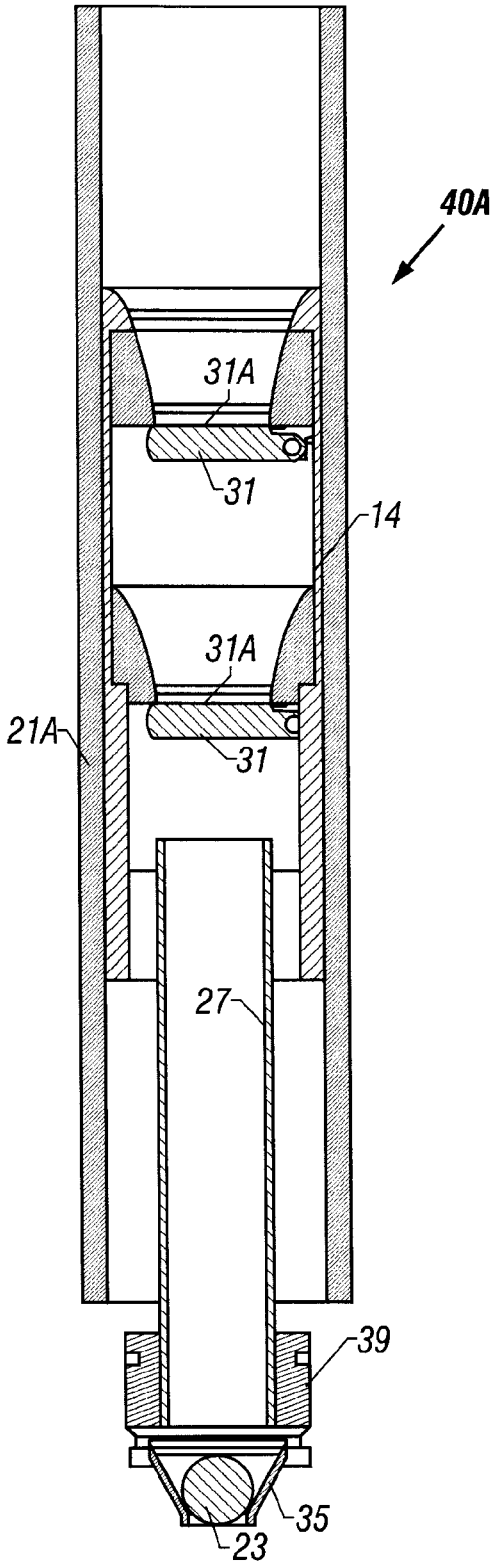
FIG. 9 is an elevational view, in section, of the embodiment of FIG. 8 after activation of an internal tube or piston by a drop ball.
Figure 10:
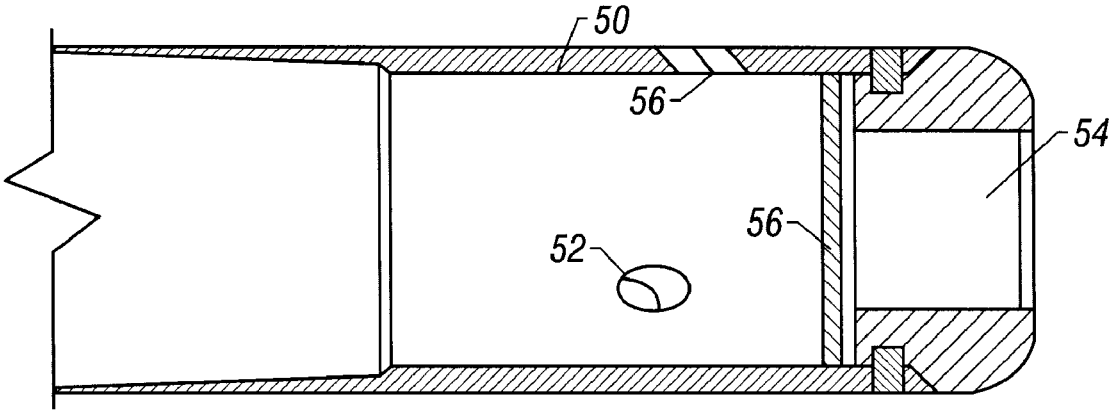
FIG. 10 is an elevational view, in section, of a guide shoe that may be used with a float collar such as the embodiment of FIG. 8 and FIG. 9.

FIG. 8 and FIG. 9 show another embodiment of the present invention in the form of float collar 40A which also comprises a double valve float equipment configuration formed within tubular collar section 21A which may have upper and lower threads thereon for insertion into the casing/liner string such as one or more joints above the bottom. Valves 31 and seats 31A are protected by sleeve 27 as discussed hereinbefore. Conversion tool 14 may be mounted by any suitable means within collar section 21A. Float collar 40A maybe used in conjunction with guide shoe 50, one example of which is shown in FIG. 10. Float collar 40A may also be used in conjunction with other guide shoes and other tubular members with down jets or up jets to be controlled. A float collar configuration, such as float collar 40A allows for a one or two joint casing shoe track below the float collar, and is more tolerant of large amounts of cuttings entering casing string 11. In FIG. 8, float collar 40A is in the run in position which permits auto fill and/or circulation when desired. In FIG. 9, float collar 40A has been converted to back pressure operation whereby valves 31 are activated.

In the particular embodiment disclosed for use with float collar 40A, but not necessarily in all embodiments, up jets 52 are positioned within guide shoe 50. Moreover, if desired, center bore 54 can be selectively sealed off such as with aluminum cover or rod 56. Aluminum cover or rod 56 or any other suitable fragile material may be designed to be breakable so that with sufficient pressure, center bore 54 can be used for downward washing and/or auto fill purposes.

Thus, the present invention provides various embodiments of float collars and float shoes. In a running position, downwardly angled jets and/or bottom center openings may be used for washing casing into position, if necessary. The casing/liner 11 may also be automatically filled as discussed above while running in. While pumping fluid or receiving fluid into casing/liner 11, and prior to converting the valves 31 to hold back pressure, the flapper valves 31 and valve sealing seats 31A are protected with piston sleeve 27 to prevent erosion. Once the drop member such as ball 23 is dropped and a selected amount of surface pressure applied, piston sleeve 27 moves down allowing the flappers to close and hold back pressure. The piston sleeve can be designed to block off the downward angled jets and, at the same time, expose upward angled jets. Now, if desired, any cement around the shoe will be circulated 100% through up jets ensuring even cement distribution and resulting in better casing shoe leak-off tests.

In general, it will be understood that such terms as "up," "down," "vertical," and the like, are made with reference to the drawings and/or the earth and that the devices may not be arranged in such positions at all times depending on variations in operation, transportation, mounting, and the like. While some boreholes are substantially horizontal rather than vertical, down is considered to be directed downhole or towards the bottom of the hole. Up is considered the direction in the hole that leads to the surface. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. As well, the relative size of the components may be greatly different from that shown. Down jets, for purposes herein are considered to have an acute angle of between zero degrees and less than ninety degrees between the vertical line heading downhole. Down jets may include a purely downward opening, such as the opening in the bottom of the tubular string. Up jets have an obtuse angle of greater than ninety degrees and less than one hundred eighty degrees with respect to the vertical line heading downhole. The up jets and down jets orientation may have a purely vertical component and a purely lateral component or more also include a circumferential component for swirling. The present invention could also be used to operate laterally directed jets, for instance, jets with a ninety degree orientation. Purely circumferentially oriented jets to swirl cement could also be used.

In one aspect of the invention, an arrangement of the apparatus of the invention provides an optimal jetting action during run in, which is switched over or converted into an optimal jetting action for cement distribution, automatically upon activation of the downhole check valves. The system is safe, economical, and very reliable. While a drop member, such as drop ball 23 is used for activating the invention in a preferred embodiment, other means for activation could also be used such as pressure activated members, fluid activated members, spring biased members, and the like, whereby passageways such as up jets/down jets may be covered and/or uncovered. Likewise valve members could be covered and uncovered. Pressure sheared members could be used for activation. Thus, the present invention may comprise a moveable member, which may be moved in response to dropping a ball, and/or shearing a member with pressure, and/or overcoming a bias element such as a spring, and/or a slidable member that may be used herein in the spirit of the invention to cover/uncover jets and/or valves. The preferred moveable member is tubular but could also be shaped in other ways such as non-tubular, as a plug, as a valve, or in other ways to effect the covering/uncovering of jets and/or valves and/or flow passages from inside to outside of a tubular string such as a casing string or liner. Moreover, multiple tubular members could be used with different tubular members having different shear members. One ball might be used to activate the first tubular member for operating a first device, a jet or other device, a second would then operate a second device when the pressure was increased, and so forth. While the present embodiment discloses specific sequences of opening and/or closing jets, any sequence of closing/opening up jets, down jets, or other jets could be used as deemed suitable for any downhole situations.

Therefore, the invention admits to many other embodiments than that shown when disclosed to those skilled in the art. It is the aim of the appended claims to cover all such modifications and variations that fall within the true spirit and scope of the invention.

What is claimed is:

1. Float collar/shoe equipment for use in lowering a tubular string into a wellbore, said equipment comprising:

an outer tubular member having an open lower end which opens into the wellbore to permit flow of fluid into or out of the tubular string bore;

an inner tubular member moveable between a first position and a second position relative to the stationary outer tubular, wherein said inner tubular member is within said outer tubular member in said first position;

one or more valves positioned between said outer tubular member and said inner tubular member when said inner tubular member is in said first position; and said one or more valves being insulated from fluid flow in said first position and being selectively engageable with fluid flow in said second position.

2. Float collar/shoe equipment of claim 1, further comprising:

one or more valve seats positioned between said outer tubular member and said inner tubular member.

3. Float collar/shoe equipment of claim 2, wherein said inner tubular member is moveable with respect to said outer tubular member from said first position to a second position for uncovering said valves and said valve seats.

4. Float collar/shoe equipment of claim 1, wherein said outer tubular member defines one or more passageways therethrough which are blocked by said inner tubular member in said first position, said one or more passageways being opened to permit fluid flow from within said tubular string to outside of said tubular string when said inner tubular member is moved from said first position to a second position.

5. Float collar/shoe equipment of claim 1, further comprising a seat secured to said inner tubular member for receiving a drop member.

6. Float collar/shoe equipment of claim 1, wherein said one or more valves comprises a plurality of flapper valves.

7. Float collar/shoe equipment of claim 1, wherein said one or more valves are held in an open position when said inner tubular member is in said first position.

8. Float collar/shoe equipment operable for use in lowering a tubular string into a wellbore prior to cementing said tubular string within said wellbore, said tubular string having an inside and an outside external to said inside, said well equipment comprising:

an outer tubular member forming a portion of said tubular string and having at least one up jet therein for directing pumped cement in an up hole direction during said cementing of said tubular string within said wellbore, each of said at least one up jets providing a passageway between said inside and said outside of said tubular string; and a moveable member, said moveable member being mounted to block fluid flow through said at least one up jet in a first position, said moveable member permitting said pumped cement to flow through said up jet in a second position.

9. Float collar/shoe equipment operable for use in lowering a tubular string into a wellbore, said tubular string having an inside and an outside external to said inside, said well equipment comprising:

an outer tubular member forming a portion of said tubular string and having at least one up jet therein, each of said at least one up jets providing a passageway between said inside and said outside of said tubular string;

a moveable member, said moveable member being mounted to block fluid flow through said at least one up jet in a first position, said moveable member permitting fluid flow through said up jet in a second position; and at least one down jet, wherein said moveable member is mounted to permit fluid flow through said at least one down jet in said first position, said moveable member being mounted to block fluid flow through said at least one down jet in said second position.

10. Float collar/shoe equipment operable for use in lowering a tubular string into a wellbore, said tubular string having an inside and an outside external to said inside, said well equipment comprising:

an outer tubular member forming a portion of said tubular string and having at least one up jet therein, each of said at least one up jets providing a passageway between said inside and said outside of said tubular string;

a moveable member, said moveable member being mounted to block fluid flow through said at least one up jet in a first position, said moveable member permitting fluid flow through said up jet in a second position; and one or more valve seats, said one or more valve seats being insulated from fluid flow in said first position and being selectively engageable with fluid flow in said second position.

11. Float collar/shoe equipment operable for use in lowering a tubular string into a wellbore, said tubular string having an inside and an outside external to said inside, said well equipment comprising:

an outer tubular member forming a portion of said tubular string and having at least one up jet therein, each of said at least one up jets providing a passageway between said inside and said outside of said tubular string;

a moveable member, said moveable member being mounted to block fluid flow through said at least one up jet in a first position, said moveable member permitting fluid flow through said up jet in a second position;

one or more valve seats: and one or more valves for operation with said one or more valve seats.

12. Float collar/shoe equipment operable for use in lowering a tubular string into a wellbore, said tubular string having an inside and an outside external to said inside, said well equipment comprising:

a moveable member operable for selectively controlling fluid flow through one or more jets, said jets directing fluid from said inside of said tubular string to said outside of said tubular string; and a drop member mounted adjacent to said moveable member, said drop member being operable in response to fluid pressure for engaging said moveable member.

13. Float collar/shoe equipment of claim 12, further comprising one or more valves, said moveable member being operable for activating said one or more valves for controlling fluid flow through said tubular string.

14. A method for completing a well operable for use in lowering a tubular string into a wellbore, said tubular string having an inside and an outside external to said inside, said method comprising:

sealing off one or more valves from fluid flow through said tubular string such that said valves are held in an open position;

selectively uncovering said valves for controlling fluid flow through said tubular string;

providing an inner tubular member moveable between a first position and a second position; and providing an outer tubular member having an open lower end which opens into said wellbore to permit flow of fluid into or out of said bore wherein said moveable inner tubular member is mounted to block fluid flow through said open lower end in said second position.

15. The method of claim 14, wherein said step of selectively uncovering further comprises dropping a member into said tubular string.

16. The method of claim 14, further comprising:

selectively closing one or more passageways between said inside of said tubular string and said outside of said tubular string.

17. The method of claim 14, wherein said step of selectively uncovering further comprises:

a drop member mounted adjacent to said inner tubular member, said drop member being operable in response to fluid pressure for engaging said inner tubular member; and utilizing a fluid pressure acting on said drop member to engage said inner tubular member.

18. The method of claim 14, wherein said step of selectively uncovering further comprises:

a drop member mounted adjacent to said inner tubular member, said drop member being operable in response to fluid pressure for engaging said inner tubular member;

providing at least one release member, wherein said release member is breakable in response to a selected fluid pressure;

utilizing said selected fluid pressure acting on said drop member to break said release member, wherein said drop member is seated in the inner tubular member; and utilizing a second fluid pressure acting on said drop member to engage said inner tubular member, wherein said inner tubular member moves from said first position to said second position.

19. A method for a well for use in installing a tubular string into a wellbore by cementing said tubular string into said wellbore, said tubular string having an inside and an outside external to said inside, said method comprising:

pumping cement into said tubular string and through one or more down jets while installing said tubular string into said wellbore; and selectively blocking said one or more down jets to prevent cement flow through said one or more down jets during said cementing of said tubular string into said wellbore.

20. The method of claim 19, further comprising:

selectively blocking one or more up jets.

21. The method of claim 19, further comprising:

selectively exposing one or more check valves to fluid pressure.

22. The method of claim 19, wherein said step of selectively blocking further comprises releasing a drop element to thereby slide a moveable member.

23. Well equipment operable for use in lowering a tubular string into a wellbore, said tubular string having an inside and an outside external to said inside, said well equipment comprising:

an outer tubular member forming a portion of said tubular string and having at least one down jet therein, each of said at least one down jets providing a passageway between said inside and said outside of said tubular string; and a moveable member, said moveable member being moveable one time only from a first position to a second position, said moveable member being mounted to permit fluid flow through said at least one down jet in said first position, said moveable member being mounted to block fluid flow through said at least one down jet in said second position.

24. The well equipment of claim 23, further comprising:

at least one up jet, said moveable member being mounted to block fluid flow through said at least one up jet in said first position, said moveable member permitting fluid flow through said up jet in said second position.

25. The well equipment of claim 23, further comprising one or more valve seats, said one or more valve seats being insulated from fluid flow in said first position and being selectively engageable with fluid flow in said second position.

26. The well equipment of claim 25, comprising one or more valves for operation with said one or more valve seats.

27. Well equipment operable for use in installing a tubular string into a wellbore by cementing said tubular string into said wellbore, said well equipment comprising:

one or more up jets formed in said tubular string;

one or more down jets formed in said tubular string; and one or more moveable members, said one or more moveable members being operable for selectively controlling fluid flow through at least one said one or more down jets for washing and for blocking said at least one or more down jets while directing cement flow through said one or more up jets for said cementing of said tubular string into said wellbore.

28. The well equipment of claim 27, further comprising:

one or more float valves to prevent reverse flow through said tubular string.

29. Well equipment operable for use in lowering a tubular string into a wellbore, said well equipment comprising:

an outer tubular member having an open lower end which opens into the wellbore to permit flow of fluid into or out of the tubular string bore;

one or more first jets formed in said tubular string;

one or more second jets formed in said tubular string; and one or more moveable members, said one or more moveable members being operable one time only for selectively opening said one or more first jets for fluid flow therethrough and for closing said one or more second jets to prevent fluid flow therethrough.

30. The well equipment of claim 29, further comprising:

one or more float valves to prevent reverse flow through said tubular string.

31. The well equipment of claim 29, wherein said one or more first jets are up jets.

32. The well equipment of claim 29, wherein said one or more second jets are down jets.

33. A float equipment assembly for lowering a tubular string from a surface position into a wellbore, said assembly comprising:

an outer tubular affixed to said tubular string;

a first flapper valve body mounted within said outer tubular, said first flapper valve body defining a first bore therethrough;

a first flapper closure element pivotally mounted to said first flapper valve body for pivotal movement between an open position and a closed position, said first flapper closure element being selectively operable between an auto-fill mode and a back pressure mode, in said auto-fill mode said first flapper closure element being secured in said open position to permit fluid flow through said first bore in a direction toward said surface position and also to permit fluid flow in a direction away from said surface position, in said back pressure mode said first flapper closure element being pivotally moveable between said open position and said closed position responsively to fluid flow direction and being mounted to thereby prevent fluid flow through said first bore in said direction toward said surface position and to permit fluid flow in said direction away from said surface position;

a second flapper valve body mounted within said outer tubular, said second flapper valve body defining a second bore therethrough;

a second flapper closure element pivotally mounted to said second flapper valve body for pivotal movement between an open position and a closed position, said second flapper closure element being selectively operable between said auto-fill mode and said back pressure mode, in said auto-fill mode said second flapper closure element being secured in said open position to permit fluid flow through said second bore in said direction toward said surface position and also to permit fluid flow in said direction away from said surface position, in said back pressure mode said second flapper closure element being pivotally moveable between said open position and said closed position responsively to fluid flow direction and being mounted to thereby prevent fluid flow through said second bore in said direction toward said surface position and to permit fluid flow in said direction away from said surface position; and an inner tubular having an inner tubular flow path therethrough, said inner tubular being initially securable at a first axial position with respect to said outer tubular, in said first axial position said inner tubular being mounted to extend simultaneously through both said first bore and said second bore to thereby secure said first flapper closure element in said open position for operation in said auto-fill mode and to secure said second flapper closure element in said open position for operation in said auto-fill mode, said inner tubular being axially moveable from said first axial position away from said first flapper valve body and said second flapper valve body to thereby release said first flapper closure element for operation in said back pressure mode and also to release said second flapper element for operation in said back pressure mode.

34. The assembly of claim 33, comprising:

a drop member receptacle mounted to said inner tubular, said drop member receptacle being operable for catching a drop member, said drop member receptacle being positioned to restrict fluid flow through said inner tubular flow path when said drop member is caught in said drop member receptacle.

35. The assembly of claim 34, further comprising:

at least one mounting member for securing said inner tubular in said first axial position, said at least one mounting member being responsive to a first selected fluid pressure to release said inner tubular when said drop member is caught in said drop member receptacle.

36. The assembly of claim 35, wherein said at least one release member is breakable in response to said first selected fluid pressure.

37. The assembly of claim 35, further comprising:

a fluid pressure-operated tool mountable to said tubular string for operation at a second selected fluid pressure, said second selected fluid pressure being different than said first selected fluid pressure.

38. The assembly of claim 37, wherein said second selected fluid pressure is less than said first selected fluid pressure.

39. The assembly of claim 34, wherein said inner tubular flow path has a sufficient internal diameter to permit a drop members having an outer diameter which is less than the internal diameter of the inner tubular, to move into said inner tubular flow path.

40. The assembly of claim 33, wherein each of said first flapper valve body, said first flapper closure element, said second flapper valve body, second flapper closure element are comprised of a drillable material.

41. The assembly of claim 33, wherein a portion of said outer tubular has an axial length in which is contained each of said first flapper valve body, said first flapper closure element, said second flapper valve body, said second flapper closure element, and said inner tubular when mounted at said first axial position, said outer tubular within said axial length comprising a cylindrical wall structure with no apertures or uncoverable apertures therein that permit fluid flow from inside of said outer tubular to outside of said outer tubular.

42. The assembly of claim 33, further comprising:

at least one shoulder formed on said outer tubular for engaging and supporting at least tubular.

43. A method for running a tubular string from a surface position into a wellbore and for cementing said tubular string within said wellbore, said method comprising:

mounting a plurality of flapper valves, having a bore, in a float equipment tubular attached to said tubular string;

covering said bore of said plurality of flapper valves by extending an inner tubular through all of said plurality of flapper valves;

running said tubular string with said float equipment tubular into the wellbore such that the wellbore fluid flows inwardly into said tubular string through said inner tubular; and removing said inner tubular from said plurality of flapper valves such that said flapper valves are pivotal to thereby open in response to a direction of fluid flow away from said surface position and to close in response to a direction of fluid flow towards said surface position.

44. The method of claim 43, wherein said step of removing said tubular further comprises:

pumping a drop member into said tubular.

45. The method of claim 44, further comprising:

seating said drop member in said tubular, and utilizing a fluid pressure acting on said drop member to remove said tubular from said plurality of flapper valves.

46. The method of claim 45, further comprising:

breaking a breakable member.

47. The method of claim 43, further comprising:

providing said drop member with a diameter of at least two inches.

48. The method of claim 43, further comprising:

forming said plurality of flapper valves from a drillable material.

49. The method of claim 43, further comprising:

providing said plurality of flapper valves with an outer diameter substantially equal to an inner diameter of said float equipment tubular such that said outer diameter of said flapper valves engages said inner diameter of said float equipment.

50. The method of claim 49, further comprising:

providing a shoulder in said float equipment tubular for securing said plurality of flapper valves in position therein.

51. The method of claim 43, further comprising:

providing each of said plurality of flapper valves with a bore greater than two inches in diameter, and providing that said tubular extending through said plurality of flapper valves has a tubular bore with an inner diameter greater than two inches and an outer diameter less than said bore of said plurality of flapper valves.

52. The method of claim 43, further comprising:

sealing off said plurality of flapper valves utilizing said tubular and at least one seal between said tubular and said float equipment tubular.

53. The method of claim 43, further comprising:

providing an opening through said plurality of flapper valves sized to reduce surge pressure.

54. Well equipment operable for use in lowering a tubular string into a wellbore, said well equipment comprising:

a moveable member;

one or more valves, said moveable member being operable for activating said one or more valves for controlling fluid flow through said tubular string; and a drop member mounted adjacent to said moveable member, said drop member being operable in response to fluid pressure for engaging said moveable member.

* * * * *

US006679336C1

(12) EX PARTE REEXAMINATION CERTIFICATE (5940th)

United States Patent
Musselwhite et al.

(10) Number: US 6,679,336 C1
(45) Certificate Issued: Oct. 9, 2007

(54) MULTI-PURPOSE FLOAT EQUIPMENT AND METHOD

(75) Inventors: Jeffrey D. Musselwhite, Houston, TX (US); Jeffry C. Ehlinger, Houston, TX (US); Jerry P. Allamon, Montgomery, TX (US); Jack E. Miller, Houston, TX (US)

(73) Assignee: Davis-Lynch, Inc., Pearland, TX (US)

Reexamination Request:
No. 90/007,350, Dec. 21, 2004
No. 90/007,586, Jun. 13, 2005

Reexamination Certificate for:

| | |
|---|---|
| Patent No.: | **6,679,336** |
| Issued: | **Jan. 20, 2004** |
| Appl. No.: | **09/982,618** |
| Filed: | **Oct. 17, 2001** |

Related U.S. Application Data

(63) Continuation-in-part of application No. 09/524,117, filed on Mar. 13, 2000, now Pat. No. 6,401,824.

(51) Int. Cl.
*E21B 34/06* (2006.01)

(52) U.S. Cl. ..... 166/386; 166/242.8; 166/332.8; 166/334.4; 166/327

(58) Field of Classification Search ..... 166/327, 166/242.8, 332.5, 334.4
See application file for complete search history.

(56) References Cited

U.S. PATENT DOCUMENTS

| | | | |
|---|---|---|---|
| 2,295,822 | A | 9/1942 | Armentrout |
| 2,735,498 | A | 2/1956 | Muse |
| 3,148,731 | A | 9/1964 | Holden |
| 3,799,204 | A | 3/1974 | Watkins |
| 4,469,174 | A | 9/1984 | Freeman |
| 4,709,760 | A | 12/1987 | Crist |
| 4,825,944 | A | 5/1989 | Mays |
| 4,967,841 | A | 11/1990 | Murray |
| 5,024,273 | A | 6/1991 | Coone |
| 5,337,819 | A | 8/1994 | Tailby |
| 5,411,095 | A | 5/1995 | Ehlinger |
| 5,474,130 | A | 12/1995 | Davis |
| 5,533,571 | A | 7/1996 | Surjaatmadja |
| 5,819,853 | A | 10/1998 | Patel |
| 6,125,930 | A | 10/2000 | Moyes |
| 6,296,059 | B1 | 10/2001 | Leeb |

(Continued)

OTHER PUBLICATIONS

"Proposed 24½ O.D. Stab–In Circulating Flexifill with Double Flapper Valve & Captive Ball (F/BP)" Unknown Baker Commodity Number (dated Jun. 25, 1984.).

(Continued)

*Primary Examiner*—Matthew C. Graham

(57) ABSTRACT

A float shoe/collar apparatus and method for multi-purpose use in running a tubular string such as a casing string or liner into a wellbore and for optimizing cementing operations. In one presently preferred embodiment, the apparatus permits auto filling of the tubular string as the string is lowered into the wellbore. Circulation can be effected through down jets for washing the wellbore as necessary. After the tubular string is positioned, the down jets can be blocked off and up jets opened to thereby direct cement upwardly to optimize cement placement. Check valves can also be activated to prevent flow from the wellbore into the tubular string. In one embodiment, the apparatus comprises an inner member and tubular member. The inner member is movable upon release of shear pins to cause longitudinal movement relative to the outer member. The movement of the inner member may close a plurality of downward jets and may also open a plurality of upward jets, if desired. The apparatus may also be equipped with a set of check valves which can be held open on run in, and subsequently activated to thereby automatically close upon cementing to prevent "u-tubing" of fluid back into the casing. In another embodiment a float collar comprises the same valve/valves as the float shoe, without jets. This float collar may be run in conjunction with a guide shoe, with or without jets.

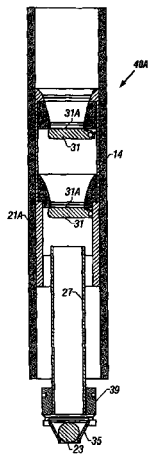

U.S. PATENT DOCUMENTS

| | | | |
|---|---|---|---|
| 6,390,200 | B1 | 5/2002 | Allamon et al. |
| 6,467,546 | B2 | 10/2002 | Allamon et al. |
| 6,484,804 | B2 | 11/2002 | Allamon et al. |
| 6,491,103 | B2 | 12/2002 | Allamon et al. |
| 6,513,590 | B2 | 2/2003 | Allamon et al. |

OTHER PUBLICATIONS

"Top Sub," Taylor Made Oil Tools, Inc. Part No. FV–3–500–13 (Jul. 7, 1997.).

"Upper Flapper Body," Taylor Made Oil Tools, Inc. Part No. FV–3–500–2 (Jul. 1997.).

"Lower Flapper Body," Taylor Made Oil Tools, Inc. Part No. FV–3–500–3 (Jul. 7, 1997.).

"Flapper Assembly," Taylor Made Oil Tools, Inc. Part No. FV–3–500–4 (Jul. 7, 1997.).

"Bottom Sub," Taylor Made Oil Tools, Inc. (Jul. 7, 1997.).

"Pin," Taylor Made Oil Tools, Inc. (Jul. 7, 1997.).

"Flapper Pin Housing," Taylor Made Oil Tools, Inc. (Jul. 7, 1997.).

"Shear Body," Taylor Made Oil Tools, Inc. Part No. FV–3–500–8 (Jul. 7, 1997.).

"Trap Body," Taylor Made Oil Tools, Inc. Part No. FV–3–500–9 (Jul. 7, 1997.).

"Sleeve," Taylor Made Oil Tools, Inc. Part No. FV–3–500–10 (Jul. 7, 1997.).

"Shear Ring," Taylor Made Oil Tools, Inc. Part No. FV–3–500–11 (Jul. 7, 1997.).

"Lock Ring," Taylor Made Oil Tools, Inc. (Jul. 7, 1997.).

"Flapper Valve," Taylor Made Oil Tools, Inc. (Jul. 7, 1997.).

"Dual Flapper Valve," Taylor Made Oil Tools, Inc., http://www.taylormadeoiltools.com/dflapval.htm.

"Hyflow Float Shoe, Product No. FB01, Hyflow Float Collar, Product No. FP01, Orifice Shoe, Product No. FZ25, Orifice Collar, Product No. FZ55, Posi–Full Collar, Product No. FZ67," Trico Well Completion Equipment, Composite Catalog of Oil Field Equipment and Service vol. 2 (1990–91.).

"2½ Cement Retainer Assembly," HPI High Pressure Integrity, Inc., Part No. 351–250–1 (Sep. 8, 1994.).

"Assembly, 7" to 20" Model 467 DV Float Collar Double Non–Circulating Fill–up Flapper with 1¾" Ball Pinned," Weatherford International, Inc. (Jul. 22, 1999.).

"Assembly, Model 367DV Float Shoe Double Non–Circulating Fill–up Flapper Downjet with Ball Pinned," Weatherford International, Inc. (Jan. 14, 2000.).

"11¾" Type 505A–DV Double–valve Auto–Fill Float Shoe," Davis–Lynch, Inc., (Dec. 4, 1998).

P. Head, et al., *Slimwells Without The Pain*, SPE/IADC 52795 (1999).

P. Head, et al., *Slimwell Concept —Innovative Coiled Tubing Completion Technology*, SPE 54492 (1999).

"Assembly for Flapper Valve Insert for Sub–Sea Re–entry Cement Float Shoe with TV Camera for XO–07238," Baker Commodity No. 02–35733–00 (dated Jan. 23, 1976).

"Proposed 24½ O.D. Stab–In Circulating Flexifill with Double Flapper Valve & Captive Ball (F/BP)" (dated Jun. 25, 1984).

3.500 O.D. Dual Flapper Valve assembly including sub–assembly drawings entitled "Top Sub," "Upper Flapper Body," "Lower Flapper Body," "Flapper Assembly," "Bottom Sub," "Pin," "Flapper Pin Housing," "Shear Body," "Trap Body," "Sleeve," "Shear Ring," "Lock Ring," "Flapper Valve," and "Dual Flapper Valve," (Taylor Made Oil Tools, Inc.,–dated Jul. 7, 1997).

"2½" Cement Retainer Assembly," HPI High Pressure Integrity, Inc., Part No. 351–250–1 (dated Sep. 8, 1994).

"B & W Orfice Shoes and Collars," Trico Industries, Inc., Product Nos. FZ25 and FZ55, advertisement published in the 1990–91 *Composite Catalog of Oil Field Equipment and Services* (1990).

"Pumpout Sleeve F/Flapper Valve Insert Assy. #233–733" Baker Commodity No. 02–33686–00 (dated Jan. 25, 1976.).

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 8–13, 19–42 and 51 is confirmed.

Claims 1–7, 14–18, 43–50 and 52–54 are cancelled.

* * * * *